US005531083A

United States Patent [19]

Franck, III et al.

[11] Patent Number: 5,531,083

[45] Date of Patent: Jul. 2, 1996

[54] CABLE LOCK DEVICE

[75] Inventors: William F. Franck, III, Greensboro, N.C.; James R. Jamerson, Martinsville, Va.

[73] Assignee: Windsor Products, Inc., Greensboro, N.C.

[21] Appl. No.: 280,073

[22] Filed: Jul. 25, 1994

[51] Int. Cl.[6] ..... E05B 73/00; E05B 67/06

[52] U.S. Cl. ..... 70/58; 70/49

[58] Field of Search ..... 70/61, 63, 69, 70/76, 233, 234, 235, 236, 49, 225, 226; 74/506; 172/13, 14; 206/403, 408, 409, 413, 414, 415, 416, 389; 242/159, 160, 170, 171, 326, 328, 348, 350, 364, 570, 578, 590–94, 596, 600, 601

[56] References Cited

U.S. PATENT DOCUMENTS

| | | | |
|---|---|---|---|
| 621,072 | 3/1899 | Gregory . | |
| 1,034,050 | 7/1912 | Williams | 70/58 |
| 2,201,305 | 5/1940 | Springer | 242/601 |
| 2,241,381 | 5/1941 | Hothersall | 220/301 |
| 3,472,364 | 10/1969 | Sloan | 206/409 |
| 3,906,758 | 9/1975 | Hurwitt | 70/30 |
| 4,033,160 | 7/1977 | Mima | 70/233 |
| 4,036,451 | 7/1977 | Pipkin | 242/137.1 |
| 4,044,577 | 8/1977 | Horlacher | 70/234 |
| 4,086,795 | 5/1978 | Foster et al. | 70/233 |
| 4,098,099 | 7/1978 | Smith | 70/18 |
| 4,112,720 | 9/1978 | Green | 70/233 |
| 4,126,024 | 11/1978 | Timmons et al. | 70/233 |
| 4,776,188 | 10/1988 | Dalaba et al. | 70/49 |
| 5,473,917 | 12/1995 | Say | 70/49 |

*Primary Examiner*—Steven N. Meyers
*Assistant Examiner*—Donald J. Lecher

[57] ABSTRACT

A cable lock is presented having a manually extendable flexible steel cable. One end of the cable can be withdrawn from the lock and the cable extended to a desired length for securing and intertwining a variety of valuable items, and the end returned to the cable lock where it is secured therein. The lock is generally bolted to a wall and a key allows the user to remove or lock the cable to secure items therewith. A generous supply of steel cable is available from an internal reel and an axially slidable, rotatable end cap provides release of the free end of the cable while in a first sector and provides continuous reel rotation to lengthen or shorten the cable while in a second sector of a cylindrical base protraction.

17 Claims, 2 Drawing Sheets

CABLE LOCK DEVICE

BACKGROUND OF THE INVENTION

1. Field of the Invention

The invention herein pertains to devices to secure personal items and particularly pertains to locking devices which have an adjustably extending cable to pass through and among the items to be protected.

2. Description of the Prior Art and Objectives of the Invention

With the increase in crime and particularly, burglary and theft throughout the United States, in recent years more and more home and business owners are employing safes and many kinds of locks to protect their property. Many homeowners who, in the past have merely locked their garage doors, now utilize secondary locks on garage and shop items of value to help prevent loss in the event of a break-in. Various types of cable locks have increased in popularity such as those set forth in U.S. Pat. Nos. 3,906,758 and 4,086,795. These devices generally employ a key lock, a reel of cable and utilize the cable free end to loop through items of value. Such locks generally employ springs and if the springs become weak or disabled, the cable locks can malfunction. In addition, such prior art devices do not have the flexibility, strength and durability as may be needed for protection under extreme adverse treatment as occurs during a burglary.

It is thus an objective of the present invention to provide a cable lock device which is simple to operate and which can be utilized in a variety of settings.

It is another objective of the present invention to provide a cable lock device which has a generous length of flexible cable to secure a number of items therewith.

It is yet another objective of the present invention to provide a cable lock device which allows the cable length to be manually adjusted and does not utilize resilient or spring members, It is also another objective of the present invention to provide a cable lock device which has a relatively few number of parts and which can be inexpensively manufactured.

It is still another objective of the present invention to provide a cable lock device which is durable under adverse treatment as may be suffered during theft.

Various other objectives and advantages of the present invention will become apparent to those skilled in the art as a more detailed presentation is set forth below.

SUMMARY OF THE INVENTION

The aforesaid and other objectives are realized by providing a cable lock device which includes an end cap having an extension affixed thereto. The end cap extension is housed in a cylindrical base which includes a protraction for receiving an end cap stud selectively in first or second sector grooves. The protraction first sector allows for approximately 55° cap rotation for locking and unlocking the cable "free" end whereas, the second sector includes a continuous groove to allow full 360° rotation of the end cap for winding and unwinding of the cable from an enclosed cable reel, A lock ring having a key hole aperture for receiving the free cable end is driven by the end cap while in the first sector to allow the free end of the cable to be retained or released. A standard deadbolt lock assembly within the cylindrical base is operated by an external key and with the bolt extended, rotation of the cable reel is prevented. The outer surface of the end cap is radially coincidental with the outer surface of the cylindrical base to provide a neat, smooth outer surface of the locking device for maximum security, durability and protection.

BRIEF DESCRIPTION OF THE PREFERRED EMBODIMENT

The preferred form of the invention is shown in FIGS. 1–4 whereby a cable locking device is provided with an internal locking ring and a cable reel. A deadbolt lock assembly is affixed within the cylindrical base to allow the deadbolt when extended to engage the reel to prevent rotation of the reel and cap therewith. A base protraction includes first and second grooved sectors for selectively receiving studs affixed to an end cap. The locking ring which is positioned within the cylindrical base provides a key hole opening for receiving a cable bonnet attached to the free end of the flexible cable which is wound on the cable reel. End cap extension teeth engage the locking ring when end cap studs are positioned within the first sector grooves of the cylindrical base protraction. The end cap extension teeth release the locking ring when the end cap studs are urged axially outwardly through axial grooves and into the continuous groove of the second sector of the base protraction so the cable reel can be selectively rotated to wind or unwind cable as needed.

DETAILED DESCRIPTION OF THE DRAWINGS AND OPERATION OF THE INVENTION

Figure 1:
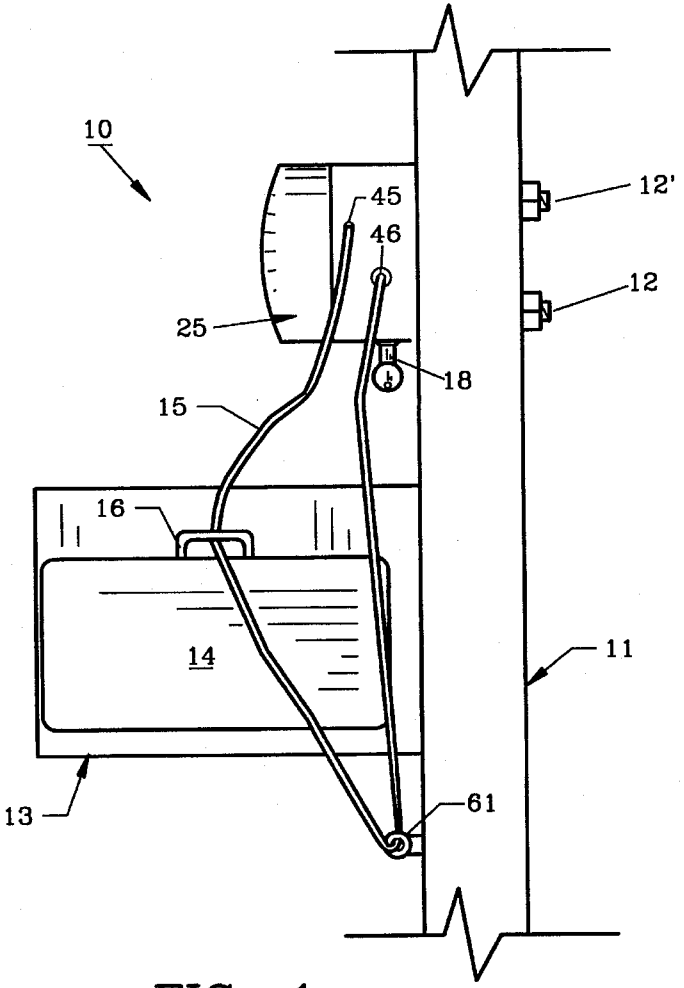
FIG. 1 illustrates a top view of the cable lock device as attached to a wall for securing a nearby briefcase.

Turning now to the drawings, cable lock device 10 is shown in FIG. 1 mounted by threaded bolts 12, 12' to wall 11. A secured eyelet 61 is shown attached to wall 11. Cable lock device 10 is positioned proximate shelf 13 which maintains briefcase 14 thereon. Briefcase 14 may contain valuable papers, securities or the like. As further seen, cable lock device 10 provides flexible steel cable 15 which passes through eyelet 61 and handle 16 of briefcase 14. Cable lock device 10 could be used for any of a variety of locking purposes to secure valuable items for preventing theft, loss, unauthorized use, availability of items to children and for other purposes. Cable lock device 10 could be used in a homeowner's garage to prevent lawnmowers or other items from being stolen or removed by entwining a sufficient length of cable 15 therearound in any of a variety of configurations. Cable lock device 10 may contain approximately sixteen feet of one-quarter inch braided steel cable 15 having an outer pliable plastic coating to prevent scarring of paint or marring of wood or leather items. Cylinder base 29 together with reel flange 21 and 23 and reel drum 44 tightly enclose flexible cable 15 and prevents expansion and escapement of wound cable 15.

Figures 2, 2A, 2B, 2C, 2D:
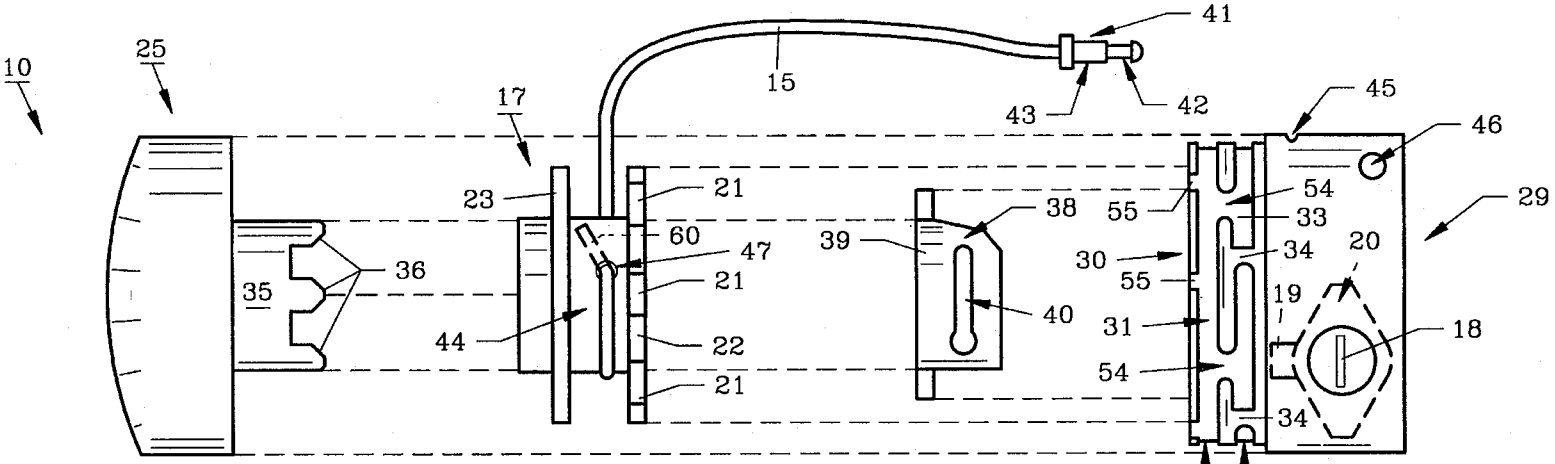
FIG. 2 demonstrates an exploded side elevational view of the lock device as shown in FIG. 1.
FIGS. 2A–2D show front views of the internal components of the lock device as seen in FIG. 2.

Cable reel 17 includes flexible cable 15 which can be extended by unlocking cable reel 17 after inserting lock key 18 into lock bolt assembly 20 and rotating key 18 approximately 180°. Rotation of key 18 causes lock bolt 19 to retract into lock bolt assembly 20 as shown in FIG. 2, thereby releasing cable reel 17. As shown in FIGS. 2 and 2A–2D, lock bolt 19 engages one of a plurality of bolt slots 21 as shown on cable reel 17. Lock bolt slots 21 are positioned on rear reel flange 22 while front reel flange 23 is substantially circular and does not contain lock bolt slots. Reel flange 23 may contain a slot for visible viewing of cable 15 during assembly, if desired. Central reel drum 44 is attached between rear reel flange 22 and front reel flange 23 and provides cable aperture 47 to frictionally engage captured end 60 of cable 15. Once key 18 has been turned to retract lock bolt 19, end cap 25 can be manually rotated. Cylindrical base 29 as shown in FIG. 2 is attached to base protraction 30, which as further shown includes first sector 27 which comprises a series of lands 34 and grooves 33 to allow cap studs 26 (FIG. 2A) of end cap 25, to rotate only approximately 55°. This limited rotation drives locking ring 38, which as shown in FIGS. 2 and 2C, includes flanges 39, 39'. Flange 39 defines key hole opening 40. Key hole opening 40 receives free end 41 of flexible cable 15 as opening 40 engages annular groove 42 of cable bonnet 43 as shown in FIG. 2. Cable bonnet 43 may be formed of steel or other durable materials. End cap 25 is attached to end cap extension 35 which utilizes tapered cap extension teeth 36 to engage teeth slots 37 of locking ring 38 as seen in FIG. 2C.

Once cable reel 17 is unlocked by key 18, it is free to rotate to wind or unwind cable 15 therearound when end cap 25 is urged axially outwardly (right to left as shown in FIG. 2) with end cap studs 26 transgressing first sector 27 and engaging groove 31 of second sector 28. Studs 26 pass along axial grooves 54 between first sector 27 and second sector 28 and end cap 25 can be completely removed as studs 26 pass through terminal grooves 55 on second sector 28. Groove 31 is continuous, without interruption and with cap studs 26 so engaged, allows end cap 25 to rotate freely in either direction. When end cap 25 is so positioned, cable 15 can be fully wound or unwound by reel 17 as desired. As would be further understood, cable 15 can be manually pulled through base port 45 to a desired length with reel 17 released. Cable bonnet 43 which is affixed to cable free end 41 can then be inserted into base port 46, and secured in place with end cap 25 urged axially inwardly for engaging (as hereinbefore described) with first sector grooves 33 and rotated clockwise. Next, key 18 is rotated 180° counterclockwise to extend bolt 19 whereupon cable reel 17 is secured and further substantial rotation is terminated. Cap end studs 26 must be in first sector 27 and cap 25 rotated fully clockwise for lock bolt 19 to engage slots 21 of cable reel 17.

In FIG. 2D planar base end 32 is seen which defines four mounting apertures 50, 51, 52, and 53 which may be approximately 0.5 inches in diameter for receiving mounting bolts 12, 12' (FIG. 1) therethrough. Inside shoulder 58 is useful in preventing cable reel 17 from applying pressure to locking ring 38.

Figure 3:
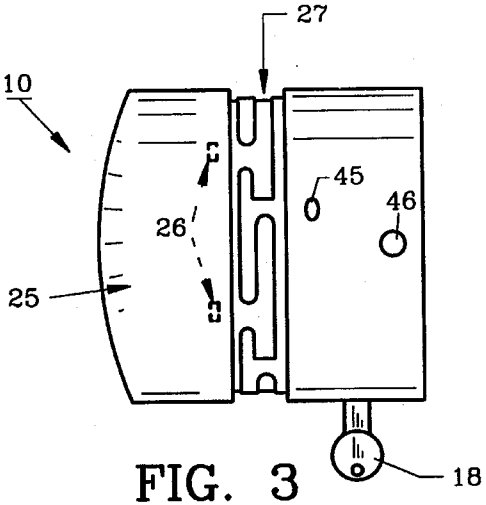
FIG. 3 depicts the end cap as positioned on the second sector of the base protraction.
Figure 4:
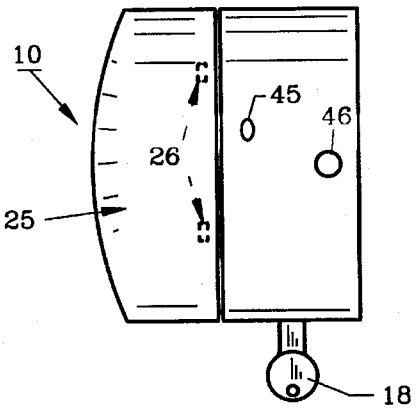
FIG. 4 pictures the end cap as positioned on the first sector of the base protraction.

FIGS. 3 and 4 illustrate the axial movement and radial rotation of end cap 25 to first (FIG. 4) unlock cable bonnet 43 (FIG. 2) utilizing first sector 27. In FIG. 3, end cap 25 with cap studs 26 positioned in groove 31 of second sector 28 allows withdrawal or extension of flexible cable 15 to form a longer exterior length of cable 15. As provided in FIGS. 2A and 2B, shoulder 48 of end cap 25 is positioned on shoulder 49 of cable reel 17 when assembled to drive the same as end cap 25 is rotated.

The illustrations and examples provided herein are for explanatory purposes and are not intended to limit the scope of the appended claims.

We claim:

1. A cable lock device comprising: a cylindrical base, a grooved protraction, said protraction attached to said base, an end cap, an end cap extension, said end cap extension attached to said end cap, said end cap extension for insertion into said cylindrical base, a cap stud, said cap stud joined to said cap, said cap stud for selective engagement with said grooved protraction for rotation therein, a locking ring, said locking ring contained within said cylindrical base, for engagement and a cable reel, said cable reel mounted within said cylindrical base for cable storage thereon and release therefrom upon selected rotation of said end cap.

2. The device of claim 1 wherein said locking ring defines a cable end slot.

3. The device of claim 1 and including a lock bolt assembly, said lock bolt assembly affixed within said cylindrical base, said lock bolt assembly comprising a bolt, said bolt for engagement with said cable reel to prevent rotation thereof.

4. The device of claim 1 wherein said end cap is axially aligned with said cylindrical base.

5. The device of claim 1 wherein said grooved protraction comprises a plurality of lands and grooves.

6. The device of claim 1 wherein said cable reel defines a plurality of lock bolt slots.

7. The device of claim 1 wherein said cylindrical base and said end cap are formed of plastic.

8. The device of claim 1 and including an end cap shoulder, said end cap shoulder positioned within said end cap, a cable reel shoulder, said cable reel shoulder positioned within said cable reel, said end cap shoulder placed proximate said cable reel shoulder to rotate said cable reel upon rotation of said end cap.

9. The device of claim 1 and including a plurality of end cap extension teeth, said end cap extension teeth attached to said end cap extension, said cap extension teeth for engaging said locking ring to cause rotation thereto as said end cap is selectively rotated.

10. The device of claim 1 wherein said grooved protraction comprises a first sector and a second sector, said first sector defining a plurality of lands and grooves, and said second sector defining a single continuous groove.

11. A cable lock device comprising: a cylindrical base, a grooved protraction, said grooved protraction having first and second sectors, said grooved protraction attached to said base and axially aligned therewith, a cable reel, said reel rotatably mounted within said cylindrical base for containing flexible cable thereon, said cylindrical base defining cable outlet and inlet ports, an end cap, an end cap extension, said end cap extension positioned within said cylindrical base, said end cap extension attached to said end cap, an end cap extension tooth, said end cap extension tooth joined to said end cap extension, a cap stud, said cap stud for selective rotation within said first and said second sectors to rotate said cable reel, and a locking ring, said locking ring engaging said cap extension tooth.

12. The device of claim 11 wherein said locking ring defines a cable slot for receiving the free end of the cable.

13. The device of claim 11 and including a lock bolt assembly, said lock bolt assembly positioned within said cylindrical base for securing said cable reel.

14. The device of claim 11 and including a planar end member, said planar end member defining a plurality of mounting apertures.

15. The device of claim 11 and including a flexible cable, said cable attached to said cable reel, said cable having a free end, a cable bonnet, said bonnet attached to said cable free end.

16. The device of claim 15 wherein said bonnet defines an annular groove.

17. The device of claim 15 wherein said cable reel comprises a flange, a drum, said flange affixed to said drum, and said drum defining a cable aperture.

* * * * *